US006632990B2

(12) United States Patent
Menzel et al.

(10) Patent No.: US 6,632,990 B2
(45) Date of Patent: Oct. 14, 2003

(54) MOUNTING CLAMP FOR BASS-DRUM FOOT PEDAL

(75) Inventors: Karl-Heinz Menzel, Wingeshausen (DE); Werner Sassmannshausen, Wingeshausen (DE)

(73) Assignee: Sonor Johs. Link GmbH, Berleburg (DE)

( * ) Notice: Subject to any disclaimer, the term of this patent is extended or adjusted under 35 U.S.C. 154(b) by 0 days.

(21) Appl. No.: 10/085,629

(22) Filed: Feb. 28, 2002

(65) Prior Publication Data

US 2002/0121178 A1 Sep. 5, 2002

(30) Foreign Application Priority Data

Mar. 1, 2001 (DE) ..... 101 09 945

(51) Int. Cl.[7] ..... G10D 13/02
(52) U.S. Cl. ..... 84/422.1; 84/422.2; 84/422.3
(58) Field of Search ..... 84/422.1, 422.2, 84/422.3

(56) References Cited

U.S. PATENT DOCUMENTS 2,446,508 A 8/1948 Crowell
3,426,640 A 2/1969 Slingerland
5,726,370 A * 3/1998 Yanagisawa ..... 84/422.1
6,011,208 A * 1/2000 Hoshino ..... 84/422.1
6,166,312 A 12/2000 Brewster

FOREIGN PATENT DOCUMENTS

DE 4020794 1/1991
EP WO-97/06526 2/1997

* cited by examiner

*Primary Examiner*—Kimberly Lockett
(74) *Attorney, Agent, or Firm*—Herbert Dubno; Andrew Wilford

(57) ABSTRACT

A drum having an annular rim is connected to a pedal assembly by a clamp having an outer clamp part engaging an outer surface of the rim only at a pair of locations axially spaced along the rim and an inner clamp part generally aligned with the outer part and engaging an inner surface of the rim only at a pair of locations axially spaced along the rim and lying between the locations of the outer clamp part. The clamp parts are pressed toward each other against the respective surfaces of the rim, and a coupling secures the clamp parts to the pedal assembly.

12 Claims, 5 Drawing Sheets

MOUNTING CLAMP FOR BASS-DRUM FOOT PEDAL

FIELD OF THE INVENTION

The present invention relates to a drum foot-pedal assembly. More particularly this invention concerns a mounting clamp for a bass-drum foot pedal.

BACKGROUND OF THE INVENTION

A bass drum in a drum set typically sits on the floor with its axis horizontal and axis of its skins lying in a vertical plane and turned toward the drummer. The drum is cylindrical and has at each end a counterhoop or rim that is used to pull the drum head tight. A foot-pedal assembly is secured to this rim and carries a beater and a pedal that is connected to the beater such that, when the pedal is depressed, the beater strikes the drum head. Such an assembly typically comprises a base that sits on the floor and that has two upright and spaced posts bridged by a shaft carrying a mount for the stick of the beater. The pedal is hinged on the base and has an end attached by a linkage to the mount so that, when the pedal is depressed, the shaft rotates and the head of the beater moves toward the drum skin. A spring unit pulls the beater head back from the drum skin and raises the pedal after each actuation.

The pedal assembly is attached to the drum so that, as the drum is played, the pedal and drum do not move apart. To this end a simple two-part clamp is normally provided that radially grips the drum rim and that is attached to the pedal-assembly base plate.

While in cheaper drum sets the rims are made of metal, in better sets they are made of hardwood, for instance maple, which has a better appearance and allegedly gives a better tone to the drum. Such wood rims are somewhat more fragile than the metal ones and the normally metallic clamps that are provided on standard pedal assemblies can damage them. This is particularly a problem when the clamp is set up such that it must be fitted on and tightened each time the drum set is set up.

OBJECTS OF THE INVENTION

It is therefore an object of the present invention to provide an improved drum-pedal clamp.

Another object is the provision of such an improved drum-pedal clamp which overcomes the above-given disadvantages, that is which can solidly grip even a fine wooden rim without damaging it.

A further object is to provide such a clamp with a particularly effective quick-disconnect and -connect feature.

SUMMARY OF THE INVENTION

A drum having an annular rim is connected to a pedal assembly by a clamp having according to the invention an outer clamp part engaging an outer surface of the rim only at a pair of locations axially spaced along the rim and an inner clamp part generally aligned with the outer part and engaging an inner surface of the rim only at a pair of locations axially spaced along the rim and lying between the locations of the outer clamp part. The clamp parts are pressed toward each other against the respective surfaces of the rim, and a coupling secures the clamp parts to the pedal assembly.

The offset contact points of the two clamp parts ensures that the clamping has an axial effect and does not simply compress and, often, crush the rim. This system is much more effective on high-quality wood rims and at the same time ensures that the pedal assembly will be solidly attached to the drum.

The inner part according to the invention is shorter than the outer part measured parallel to the rim. Parallel to the rim means angularly relative to the normally horizontal axis on which the drum is centered and which passes centrally and perpendicularly through the two drum skins. Making the inner part shorter allows the contact points to be constituted at the ends of the two parts and inherently makes the inner-part contact points lie inside the outer-part contact points. These points themselves are formed by pads at which the respective parts contact the respective surfaces of the rim. The are elastomeric, either of rubber or an elastomeric plastic.

In accordance with the invention the coupling between the clamp and the foot-pedal assembly is releasable. It includes a seat formed on the clamp parts and a coupling element carried on the pedal assembly and fittable in the seat. Thus the clamp can be left on the drum so that, when the drum set is moved, it is merely necessary to uncouple the pedal assembly from the clamp. This construction avoids the possibility of damaging the rim by repeatedly mounting the clamp on and taking it off the rim. The means for pressing the two clamp parts together includes screws engaged between the clamp parts. Four screws are used, two for coarse adjustment and two for fine adjustment so that the parts can be set parallel to each other and to the drum axis, ensuring that they will not scratch the rim. In other words two of the screws serve to hold the clamp parts apart, and two serve to pull them together.

The parts together form a concave seat open toward the pedal assembly which may be lined with cushioning material. In addition the clamp parts are plate-shaped and the pedal assembly has a rod engageable complementarily in the seat. In this case the coupling includes another seat formed on the clamp parts and a coupling element carried on the pedal assembly and fittable in this other seat. The pedal assembly further includes a base plate carrying the coupling element, a lock device for displacing the coupling element when engaged in the seat toward the base plate for pressing the base plate into the seat, a beater, a pedal, and a linkage engaged between the pedal and the beater for striking a head of the beater against the drum when the pedal is actuated.

The coupling in accordance with the invention includes a shaft displaceable by the lock device and having a head projecting past the base plate and complementarily engageable in the seat. The lock device includes a lever actuatable to displace the head toward and away from the base plate which itself is provided with a pair of upstanding posts between which the rod extends. The rod is provided with cushioned sleeves engageable in the seat and the shaft carrying the head projects through the rod and is slidable in the base plate. The lever carries a cam engageable with the shaft. Thus with this system the pedal assembly can extend at an angle to the clamp, since the shaft fitting in the concave seat can hold at any of a plurality of angularly offset positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
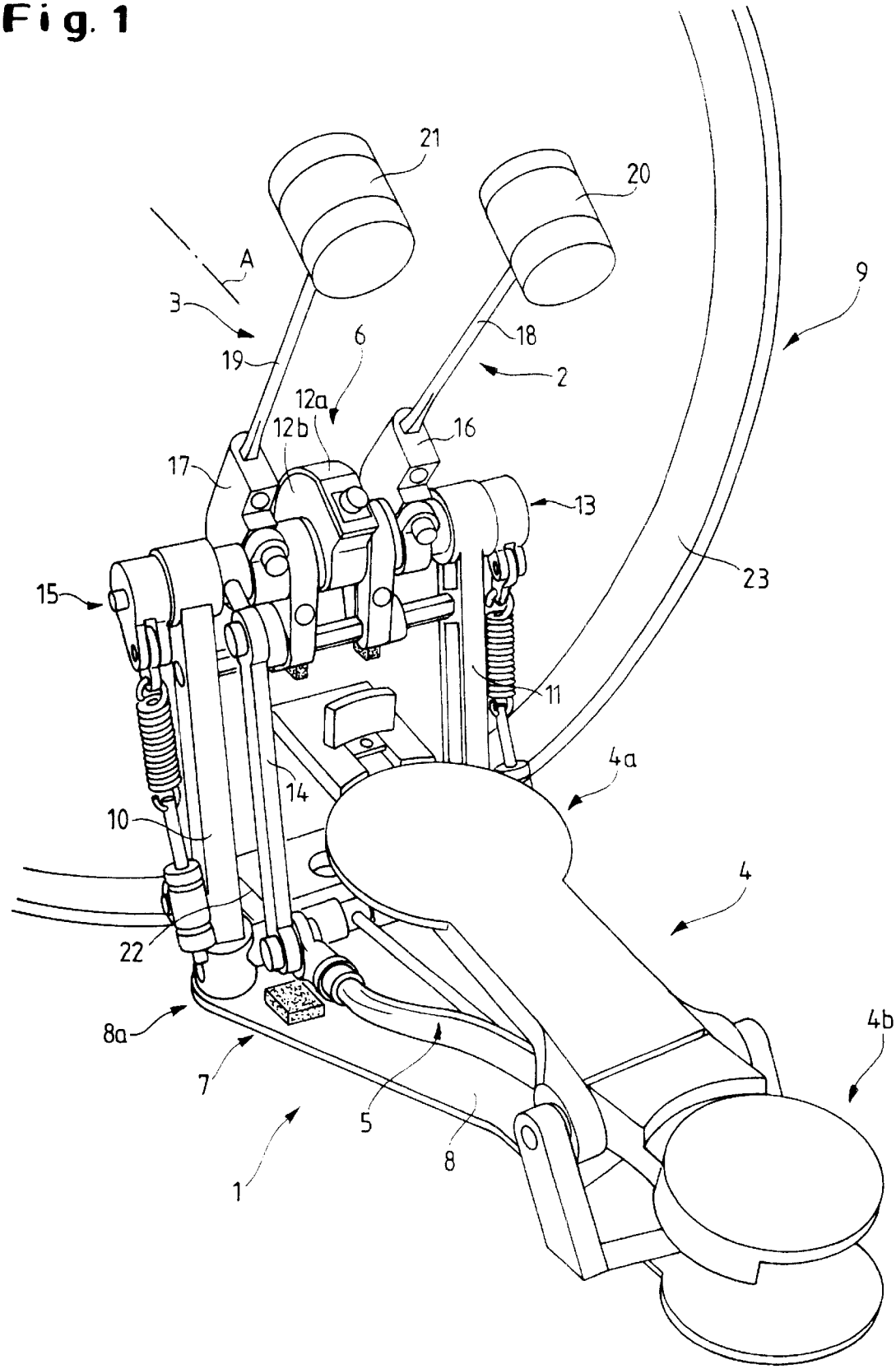
FIG. 1 is a perspective view of a pedal assembly according to the invention.

As seen in FIG. 1 a pedal assembly 1 in accordance with the invention has two beaters 2 and 3 operated by respective parts 4*a* and 4*b* of a pedal 4 via respective linkages 5 and 6. The assembly 1 has a base 7 comprised as a base plate 8 adapted to sit on the floor adjacent a base drum 9 and having a pair of parallel and spaced posts 10 and 11. The part 4*a* is connected via a strap 12*a* to a mount 12*b* fixed on a shaft 13 extending from the post 11 and the part 4*b* by a push rod 14 to a shaft 15 extending coaxially to the shaft 13 from the post 10. The shafts 13 and 15 carry respective mounts 16 and 17 for sticks 18 and 19 carrying beads 20 and 21 of the respective beaters 2 and 3. This structure corresponds to that described in copending application 10/085,628.

The base plate 8 is connected via a clamp 22 to a circular counterhoop or rim 23 of the drum 9. This clamp 22 basically comprises an inner or upper plate-shaped part 24 and an outer or lower plate-shaped part 25 that together grip the rim 23. The part 24 is shorter than the part 25 seen longitudinally of the hoop 23, that is parallel to the view plane in FIG. 2. The upper part 24 has a lower or outer surface 27 carrying a pair of contact elements or pads 29 and 30 and the lower part 25 has an inner or upper surface 28 carrying a similar pair of much contact elements or pads 31 and 32. The pads 29, 30, 31, and 32 are made of rubber or another elastomer and have respective curved surfaces 33, 34, 35, and 36 that correspond to the curvature of the rim 23. An upper side 43 of the upper part 24 has further such contact pads 39 and 40 and a lower side 44 of the part 25 has further such pads 41 and 42 so that they can be inverted and used. Here the pads 41 and 42 also support the clamp 22 on the floor. The pads 29 and 30 or 39 and 40 of the upper part 24 are spaced more closely than the pads 31 and 32 or 41 and 42 of the lower part 24, so that the pads of the lower part 25 are never directly across the rim 23 from the pads of the upper part 24.

Figure 2:
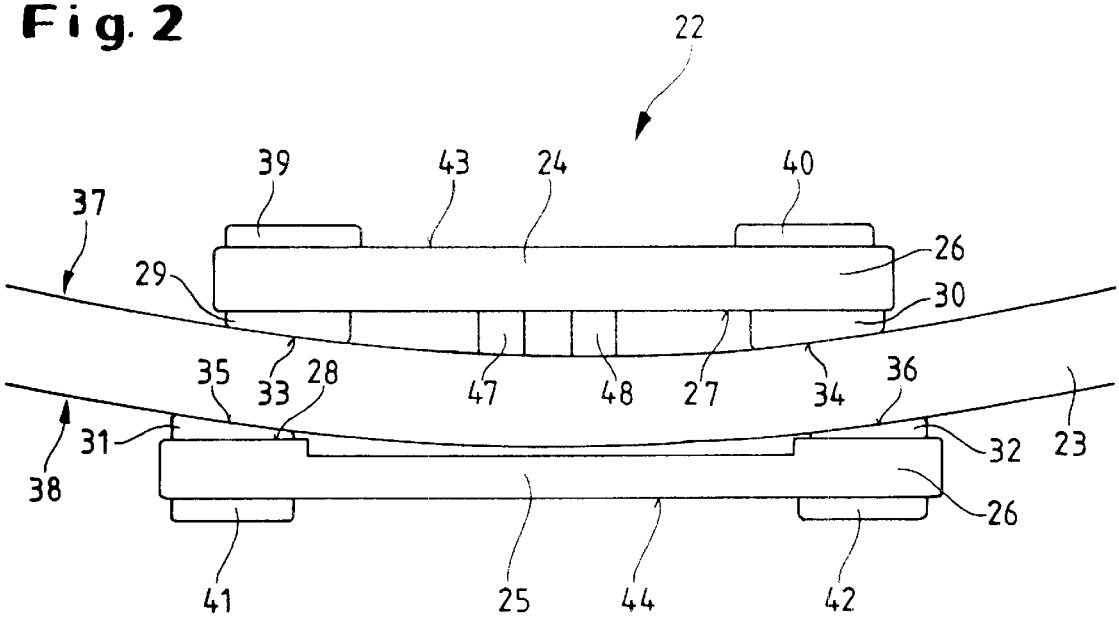
FIG. 2 is an end view of the clamp of this invention.
Figure 3:
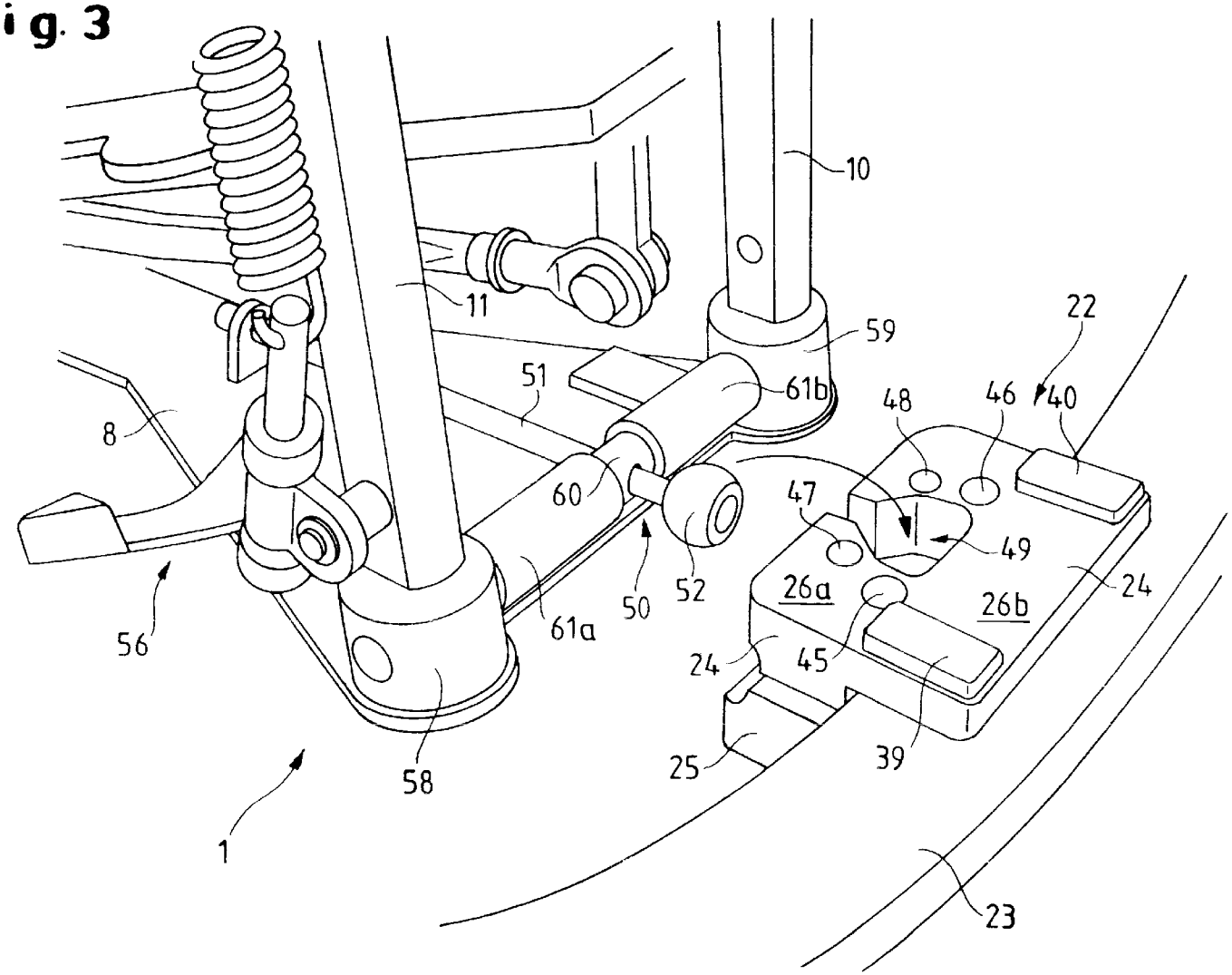
FIGS. 3, 4, and 5 are perspective views taken from various angles before, during, and after the pedal assembly is connected to the drum.

In order to position the clamp 2 the upper part 24 and the lower part 25 are set across from each other on the rim 23 to grip it. Then they are fixed together with screws 45 through 48, the screws 45 and 46 pulling the two parts 24 and 25 together and the screws 47 and 48 holding them apart at a certain minimal spacing so the two plate-shaped parts 24 and 25 remain parallel to each other and to a center axis A (FIG. 1) of the drum 9. FIG. 2 shows in particular how as a result of the offset contact points between the pads engaging the rim 23 the clamp 22 is set stress free.

In order that the pedal assembly 1 can be detached easily from the clamp 22 it has a snap coupling 56 formed by a meat 49 in which a complementary element 50, here a rod 51 with a ball head 52, can fit. The outer edges 53 and 54 of the parts 24 and 24 are angled toward each other to form a part-cylindrical seat 55 centered on a horizontal axis and concave toward the base plate 8. The base 8 has a contact rod 60 extending between the sockets 58 and 59 in which lower ends of the posts 10 and 11 are seated. A pair of elastomeric sleeves 61*a* and 61*b* are fitted over this rod 60 to each side of a diametral and horizontally throughgoing hole 62 that, slidingly accommodates the rod 51.

Figure 4:
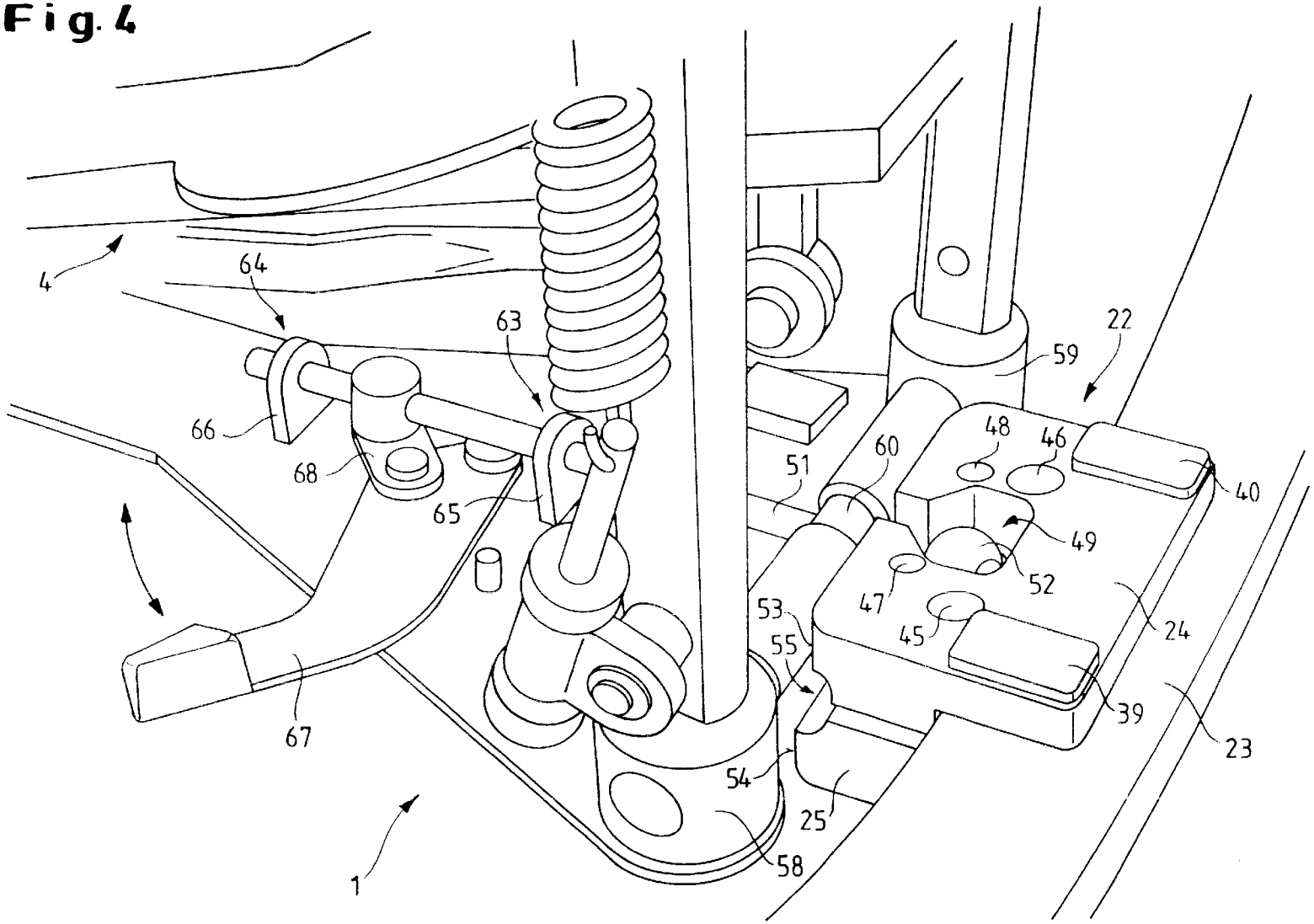
Figure 5:
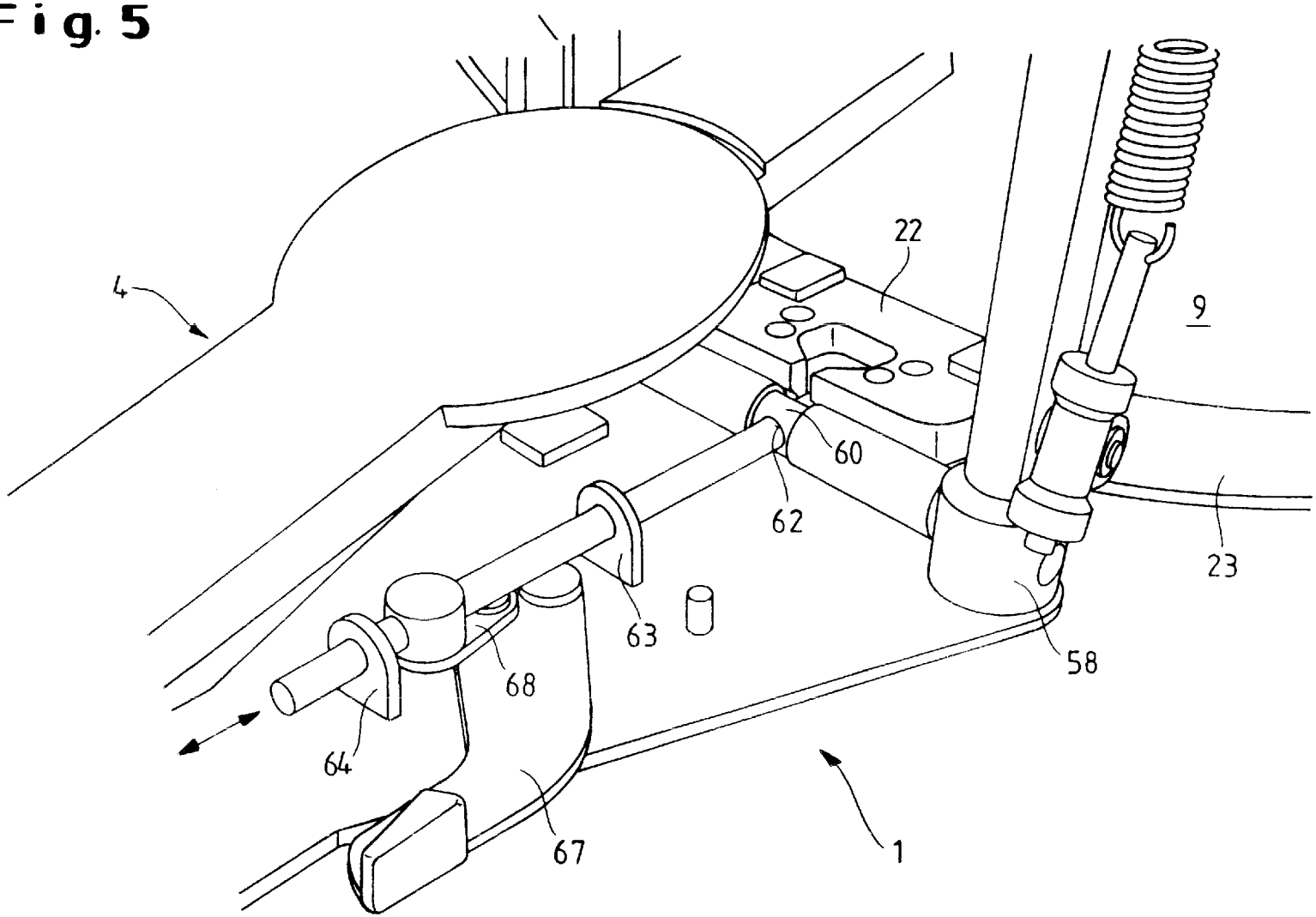

A rear end 66 of the rod 61 slides in lugs 63 and 64 having holes aligned with the hole 62 and a center portion of the rod 61 coacts with a cam 68 mounted on a lever 67 that can pivot on the base 8 to move the rod 51 longitudinally. In this manner once the ball 52 is engaged in the seat 49, the lever 67 can be pulled back to pull the ball 52 back toward the plate 8 and seat the cushioned sleeves 61*a* and 61*b* of the rod 60 in the seat 55, thereby moving the structure from the FIG. 4 position to the FIG. 5 position and solidly locking the base plate 8 to the clamp 22 while at the same time allowing it to extend at an angle thereto.

We claim:

1. In combination with a drum having an annular rim and with a pedal assembly, a clamp comprising:

an outer clamp part engaging an outer surface of the rim only at a pair of locations spaced along the rim;

an inner clamp part generally aligned with the outer part and engaging an inner surface of the rim only at a pair of locations spaced along the rim and lying between the locations of the outer clamp part;

means for pressing the clamp parts toward each other against the respective surfaces of the rim; and a coupling securing the clamp parts to the pedal assembly.

2. The drum pedal-assembly clamp defined in claim 1 wherein the inner part is shorter than the outer part measured parallel to the rim.

3. The drum pedal-assembly clamp defined in claim 1 wherein the parts are provided with pads at which they contact the respective surfaces of the rim.

4. The drum pedal-assembly clamp defined in claim 3 wherein the pads are elastomeric.

5. The drum pedal-assembly clamp defined in claim 1 wherein the means for pressing includes screws engaged between the clamp parts.

6. In combination with a drum having an annular rim and with a pedal assembly, a clamp comprising:

an outer clamp part engaging an outer surface of the rim only at a pair of locations spaced along the rim;

an inner clamp part generally aligned with the outer part and engaging an inner surface of the rim only at a pair of locations spaced along the rim and lying between the locations of the outer clamp part;

means for pressing the clamp parts toward each other against the respective surfaces of the rim; and a releasable coupling securing the clamp parts to the pedal assembly, the coupling including a coupling seat formed on the clamp parts, and a coupling element carried on the pedal assembly and fittable in the coupling seat.

7. In combination with a drum having an annular rim and with a pedal assembly having a rod, a clamp comprising:

an outer plate-shaped clamp part engaging an outer surface of the rim only at a pair of locations, spaced along the rim;

an inner plate-shaped clamp part generally aligned with the outer part and engaging an inner surface of the rim only at a pair of locations spaced along the rim and lying between the locations of the outer clamp part, the parts together forming a concave seat open toward the pedal assembly and fittable with the pedal-assembly rod;

means including screws engaged between the clamp parts for pressing the clamp parts toward each other against the respective surfaces of the rim; and a coupling securing the clamp parts to the pedal assembly, the coupling having a coupling seat formed on the clamp parts, and a coupling element carried on the pedal assembly and fittable in the coupling seat.

8. The drum pedal-assembly clamp defined in claim 7 wherein the pedal assembly includes:

a base plate carrying the coupling element;

locking means for displacing the coupling element when engaged in the coupling seat toward the base plate for pressing the base plate into the concave seat;

a beater, a pedal; and means including a linkage engaged between the pedal and the beater for striking a head of the beater against the drum when the pedal is actuated.

9. The drum pedal-assembly clamp defined in claim 8 wherein the coupling includes a shaft displaceable by the locking means and having a head projecting past the base plate and complementarily engageable in the coupling seat, the locking means including a lever actuatable to displace the head toward and away from the base plate.

10. The drum pedal-assembly clamp defined in claim 9 wherein the base plate is provided with a pair of upstanding posts between which the rod extends.

11. The drum pedal-assembly clamp defined in claim 10 wherein the rod is provided with cushioned sleeves engageable in the concave seat.

12. The drum pedal-assembly clamp defined in claim 9 wherein the shaft carrying the head projects through the rod and is slidable in the base plate, the lever carrying a cam engageable with the shaft.

* * * * *